US005725215A

United States Patent [19]

Hesse

[11] Patent Number: 5,725,215

[45] Date of Patent: Mar. 10, 1998

[54] METHOD FOR PLAYING A CARD GAME

[75] Inventor: Michael A. Hesse, Westlake Village, Calif.

[73] Assignee: Helix Information Services, Inc., Westlake Village, Calif.

[21] Appl. No.: 670,362

[22] Filed: Jun. 26, 1996

[51] Int. Cl.[6] ..... A63F 1/00

[52] U.S. Cl. ..... 273/292; 273/274

[58] Field of Search ..... 273/274, 292, 273/309; 463/12, 13

[56] References Cited

U.S. PATENT DOCUMENTS

| | | | |
|---|---|---|---|
| 5,395,119 | 3/1995 | Jacob et al. | 273/274 |
| 5,397,128 | 3/1995 | Hesse et al. | 273/292 |

OTHER PUBLICATIONS

"Bacc–Jack" Casino Gaming Concepts, Inc., 1995.

*Primary Examiner*—Benjamin H. Layno
*Attorney, Agent, or Firm*—D'Alessandro & Ritchie

[57] ABSTRACT

A card game called "Pan 9 Gold" is disclosed. Pan 9 Gold is preferably played with between six and ten decks of cards with the sevens, eights, nines, and tens removed, although other numbers of decks and decks of different composition may be employed. Players play against each other rather than the casino or card room. Hence the game is not a banking game. The players are trying to reach a hand value of 9 or as close to nine as possible. Aces are worth one, face cards are worth zero, and other cards are worth their face value. Hands with a value greater than nine have their value reduced by ten until the value falls between zero and nine. In Pan 9 Gold, the player wagers against a designated player "Dealer". The designated Dealer is rotated throughout the game. The casino or card room collects a fixed amount from each player for each hand. Each player is dealt three cards, all face down. Each player has the option to take one more card or stand. The Dealer has the option to take one card, and if the Dealer takes a card, the Dealer has the option to take an additional card. The hand of the Dealer is compared to that of each player in turn and the hand with the higher value wins. The player wins in the case of a tie.

4 Claims, 4 Drawing Sheets

METHOD FOR PLAYING A CARD GAME

BACKGROUND OF THE INVENTION

1. Field of the Invention

The present invention relates to gaming and to card games. More particularly, the present invention relates to a card game called "Pan 9 Gold" in which a number of players play against one another or against a casino or card room ("the house").

2. The Prior Art

Numerous card games are known in the prior art. Some card games are predominantly games of skill, in which a player's skill significantly increases his or her chance of winning. Other card games are predominantly games of chance in which winning or losing depends on the random chance of a certain card being turned rather than the skill of the player.

There are three wagering formats common in card games involving wagering. The first is wagering against the casino (the Nevada model). The second format is wagering against the other players for a common pool (the Poker model). The third format is wagering against a designated player (the California model).

In Nevada and most other states where there is casino gambling, most wagering is against the casino. In blackjack, for example, each player is dealt a hand, and a hand is dealt for the casino. If the player loses, the casino collect the money. If the player wins, the casino pays the player. The casino makes money when the players lose more than they win.

This type of wagering is currently illegal in states such as California, due to a statutory prohibition of "banking" games. Under present California law, the gaming establishment can hold no interest in the outcome of a wager.

In poker, the players do not wager against the house. They are playing against each other. All the wagers are placed in a common pool (the pot), and the player with the best hand wins all the money wagered on that deal.

In poker-type games, the gaming establishment makes money by taking a "Collection." This is a fee collected by the gaming establishment either for each hand or for each half-hour of play. In Nevada, the collection may be a fixed amount or a percentage of the pool. In California, the collection must be a fixed amount (except for pari-mutual horse racing). A typical collection would be $1 for each hand, charged to each player. A typical time collection might be $8 per half hour for a poker game where the bets and raises are limited to $30. This form of wagering is mostly used for poker and pan (a form of rummy).

Pai Gow, a Chinese wagering game played with tiles, introduced a new wagering model to California card rooms. However, this model is familiar to anyone who has played blackjack with friends rather than in a casino. It is something of a hybrid between the other two models.

For each hand, one of the players is designated the "Dealer", and all the other players are trying to beat the Dealer. If the player beats the Dealer, the player wins and is paid off from the Dealer's wager. If the Dealer has a better hand than the player, the Dealer wins the player's wager.

Each player has the option to play the role of Dealer. Typically, a player is Dealer for two hands. Then the option is offered to the next player on the left who can become Dealer or pass the option on. There are other equivalent ways to handle the Dealer option with respect to the direction of pass (i.e., rotate to the right, etc.) and duration of Dealer status (i.e., one, three, or more hands).

The Dealer is not bound by any table limit. The Dealer frequently bets enough to cover the bet of all the players at the table. However, the Dealer is not required to make any bet other than the table minimum.

On every hand, dice are shaken and the order of payoffs is determined. This decides how the wagers are settled if the Dealer is not wagering enough money to cover all the bets made by the other players. An alternative method is to always start payoffs with the player on the Dealer's left.

The Dealer does not actually deal the cards or settle the wagers the way a Nevada blackjack dealer would. These functions are handled by a gaming establishment employee commonly called the "House Dealer." Throughout this document, the term "Dealer" will refer to the player against whom the other players are wagering. The term "House Dealer" will refer to the gaming establishment employee who actually deals the cards and runs the game.

A common game in California card rooms is the public domain game called "Pan 9" or "Super Pan 9". It uses the California wagering model where players take turns acting as Dealer. It is played with 8 or 10 decks of playing cards with the sevens, eights, nines, and tens (but not the face cards) removed.

Each player and the Dealer is dealt three cards face down. Each player has the option to draw one more card or to play the three cards dealt. The Dealer has the same options. If any player draws cards, these cards are dealt face down. After all have acted on their hands, the House Dealer, turns over each hand and compares it to the Dealer's hand. A hand's value is the sum of the values of the individual cards wherein face cards have a value of zero, all other cards have their face value, and the "tens digits" in the hand's value is ignored.

For example a hand of 3-6-5 would have a value of 4. The cards total 14 and the tens digit is ignored. A hand of K-5-3-2 would have a value of 0.

The higher hand of the player's and the Dealer's wins. Ties are pushes and no money changes hands.

A problem with Pan 9 is that the game provides no advantage to the Dealer. Casinos have found that for a game with a California wagering model to be successful, players must be motivated to be Dealer. This helps to create games and keep them going. A small advantage for the Dealer (0.5%–2.0%) appears to make a game more successful. Card rooms offering Pan 9 have noticed that there are people who want to play the game, but not enough people want to be the Dealer. That has hurt business.

It is an object of the present invention to provide an enjoyable card game.

It is a further object of the present invention to provide a card game with a small advantage for the Dealer to encourage players to be Dealer.

It is a further object of the present invention to provide a game that will be familiar to current players of Pan 9 and easy for them to learn.

BRIEF DESCRIPTION OF THE INVENTION

According to the preferred embodiment of the present invention, a card game "Pan 9 Gold" is disclosed. Pan 9 Gold is a game of skill and is played with six to ten standard decks of playing cards with the sevens, eights, nines and tens removed, although fewer or more decks may be employed.

In the preferred embodiment, players play against each other rather than the House Dealer. (Hence the game is not a banking game.) However, in an alternative embodiment, it is contemplated that the game of the present invention can be played against a House Dealer.

The players are trying to reach a card value total of 9. Aces are always worth 1. Each numbered card is worth its face value and picture cards (King, Queen, or Jack) are each worth zero. The value of a hand is the sum of the values of the cards, but hands with a total over 9 are reduced by 10, 20, 30, etc. until the value is in the range 0–9 (i.e. the "tens" digit of the value is ignored).

In Pan 9 Gold, the player wagers against a designated "Dealer." When the Dealer is designated from one of the players, the Dealer is rotated throughout the game and the house collects a fixed amount from each player for each hand. When the House is the designated Dealer, the Dealer does not rotate.

Each player and the Dealer makes their wager before any cards are dealt. Each player including the Dealer is dealt three cards face down and has the option to hit one time (add one additional card to the hand) or stand (play the original three cards).

After all the players have acted, the Dealer's hand is exposed and the Dealer has the option to hit or stand. If the Dealer hits, after the fourth card is added to the hand, (s)he may choose to hit a second time. Thus the Dealer's hand could contain three, four or five cards at the end of the action.

Then the hand held by the Dealer is compared to each of the players' hands in turn. If the Dealer's hand has a higher value than the player's hand, the Dealer wins. If the player's hand is higher or the hands tie, the player wins.

Pan 9 Gold introduces changes from the rules of Pan 9. The first rule change defines what happens in the event of a tie between the Dealer and a player. In Pan 9, in the event of a tie between the Dealer and a player, there is a "Push" and no winner. In Pan 9 Gold, the player wins in the event of a tie between the Dealer and the player.

Another rule change relates to the options of the Dealer. In Pan 9, the Dealer has the option to stand or hit. In Pan 9 Gold, the Dealer may stand, or may hit once or twice.

As a result of these changes, the Dealer in the game of Pan 9 Gold has an advantage of 0.8% to 2.1%, depending on the precise rules used.

DETAILED DESCRIPTION OF A PREFERRED EMBODIMENT

Figure 1:
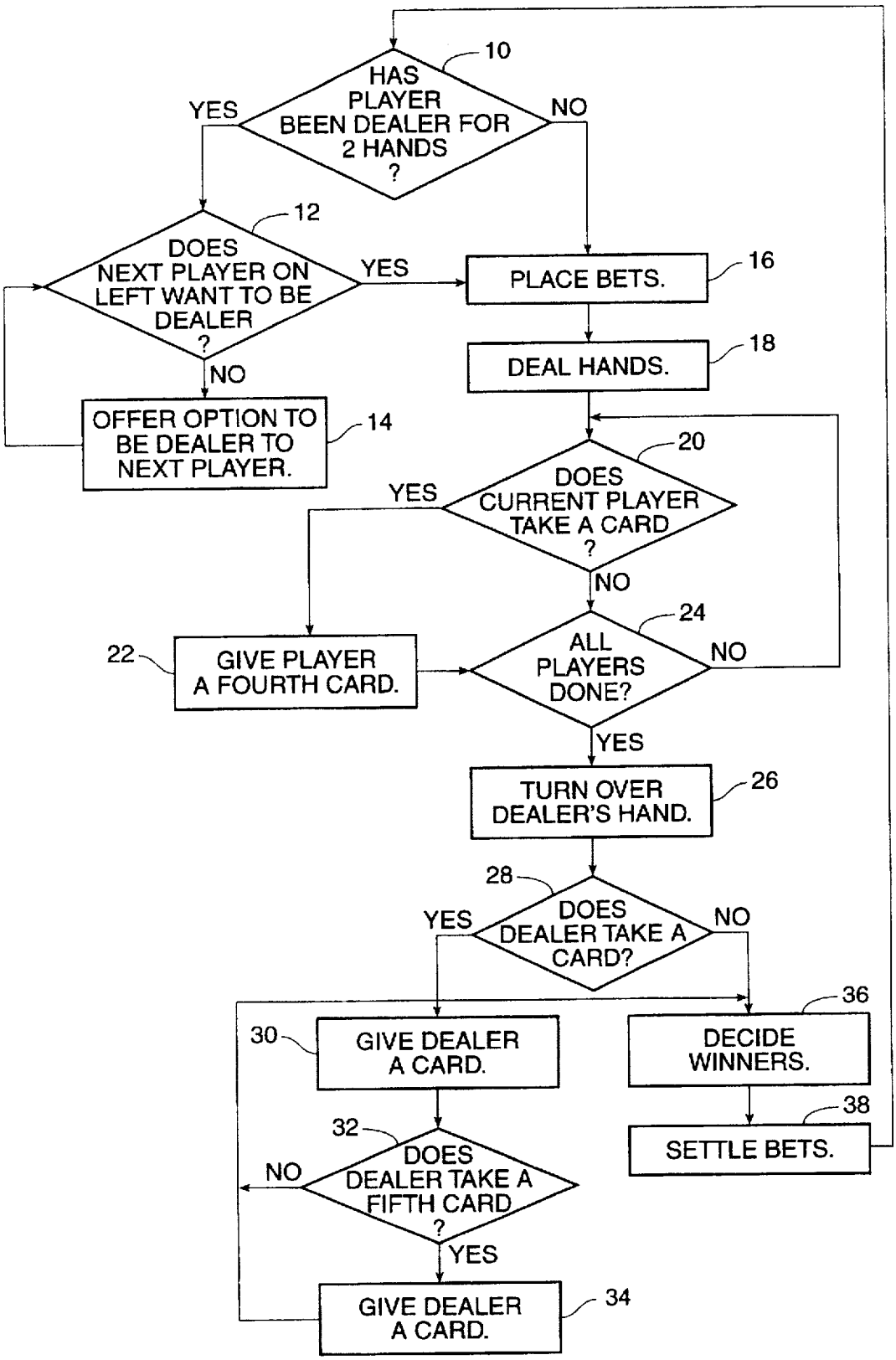
FIG. 1 is a flow chart of play of the game Pan 9 Gold according to a particular embodiment of the present invention.

Those of ordinary skill in the art will realize that the following description of the present invention is illustrative only and not in any way limiting. Other embodiments of the invention will readily suggest themselves to such skilled person.

The game of Pan 9 Gold is played with one or more decks of playing cards with the sevens, eights, nines and tens removed, although persons of ordinary skill in the art will appreciate that other combinations of cards could be added to or removed from the deck. According to the presently preferred embodiment of the game, six to ten decks are used, although it will be readily recognized that other numbers of decks could be employed.

According to the presently preferred embodiment of Pan 9 Gold, Jokers are not utilized, although they could be in variations of the game according to the present invention.

In one embodiment of the game of Pan 9 Gold, players play against each other rather than against a casino or card room. Hence the game is not a banking game specifically prohibited in states such as California. One player is designated as "Dealer" for each hand. However, as previously mentioned, in an alternative embodiment of the game of the present invention, the game may be played against a casino or card room who is designated the "Dealer" for every hand.

The object of the game is for the player to beat the Dealer or the Dealer to beat the player. The player wins by getting a hand with a higher numerical value or the same numerical value as the Dealer's. The Dealer wins by getting a hand with a higher numerical value than the player's.

For a game played with eight decks, the quantity of each card in the deck as well as its numerical value in play is shown below in Table I:

TABLE I

| CARD | QUANTITY | CARD VALUE |
|---|---|---|
| Ace | 32 | 1 |
| 2 | 32 | 2 |
| 3 | 32 | 3 |
| 4 | 32 | 4 |
| 5 | 32 | 5 |
| 6 | 32 | 6 |
| Jack | 32 | 0 |
| Queen | 32 | 0 |
| King | 32 | 0 |

Those of ordinary skill in the art will recognize that other combinations are possible which remain within the spirit and scope of the present invention. For example, nines could be kept in the decks or Jokers could be added and assigned a numerical value.

Each hand's value is a number between zero and nine. The value is found by adding the numerical values of the cards in the hand and then subtracting ten until the value falls between zero and nine. Those of ordinary skill in the art will recognize that other ways of valuing hands are possible such as requiring the hand values to fall between one and ten.

Each player has the option of hitting (adding a fourth card to the hand) or standing (playing the three cards dealt). The Dealer has the options of hitting or standing, and in addition may hit a second time after viewing the card received after a hit. A Dealer may not hit a third time. In prior-art Pan 9, a Dealer may not hit a second time. Allowing the Dealer to hit a second time adds additional suspense and excitement to the game.

Those of ordinary skill in the art will recognize that other combinations of hitting and standing are possible which remain within the spirit and scope of the present invention. For example, the player could hit twice and the Dealer could hit three times.

In Pan 9 Gold, the player wagers against a Dealer. In one embodiment of the game, each player has the option to play the role of Dealer. Typically a player is Dealer for two hands, after which the option is offered to the next player on the left who can become Dealer or pass the option on. There are other equivalent ways to handle the Dealer option with respect to the direction of pass (i.e. rotate to the right, etc.) and the duration of Dealer status (e.g., three or more hands or until the next time the cards are shuffled). In an alternative embodiment of the game, the casino will play the role of Dealer covering the wagers of all players.

Pan 9 Gold is designed to give an advantage to the Dealer with perfect play by all players. The size of the advantage depends on the house rules. With perfect play, the Dealer will win at a rate of 0.8% to 1.8% of the money wagered. This is important, since there cannot be a game unless someone is willing to be Dealer.

According to a presently preferred embodiment, Pan 9 Gold places no restrictions on the Dealer's play. Optionally, the Dealer may be required to stand on any hand with a value of six (or other value), any three-card hand with a value of six (or other value), or any four-card hand with a value of six (or other value). These optional restrictions on the Dealer's play allow the casino or card room to adjust the Dealer's advantage to encourage people to play the role of Dealer when necessary and also give the other players a reasonable chance of winning.

When a player plays the role of Dealer, the casino or card room may collect a fixed amount from each player for each hand.

The winner is determined by comparing the Dealer's hand value to the player's hand value. If the Dealer's hand value is higher the Dealer wins. If the player's hand value is higher or the same as the Dealer's, the player wins. In Pan 9, ties are "pushes" where no money exchanges hands. Pan 9 Gold gives the player this additional advantage to offset the advantage to the Dealer of being able to draw a second card. The combination of these two innovations gives the Dealer the moderate advantage that makes card games with a player Dealer successful. This also has the advantage of there being a winner on every hand, making the game more exciting.

In an alternative embodiment of the present invention, the player instead of the Dealer could be given the option of receiving a second hit and the Dealer instead of the player would win in the case of a tie. As above, optional restrictions may be placed on the Dealer's play to allow the casino or card room to adjust the Dealer's advantage to encourage people to play the role of Dealer when necessary and also give the other players a reasonable chance of winning.

According to a presently preferred embodiment where a player is designated as Dealer, the play of the game in Pan 9 Gold proceeds in the order of the following steps:

1. Each player puts out his/her bet.
2. Each player places the collection in a separate space marked on the table.
3. Dice are shaken in a cup to determine the order of payoffs if the Dealer does not wager enough to cover all the wagers.
4. Each player and the Dealer is dealt three cards face down.
5. Each player examines his/her cards and decides to hit or stand. Typically the player places the cards in boxes drawn on the table to indicate his/her choice.
6. The House Dealer gives each player who chooses to hit, another card face down.
7. The House Dealer turns the Dealer's cards face up.
8. The Dealer chooses to hit or stand. If the Dealer chooses to hit, the House Dealer adds a fourth card, face up, to the Dealer's hand.
9. The Dealer may then choose whether to hit a second time or to stand. If the Dealer chooses to hit again, the House Dealer adds a fifth card to the Dealer's hand.
10. The House Dealer turns over all the player hands, determines whether each hand wins or loses to the Dealer, and settles the wagers to the extent the Dealer's money covers the bets. If the Dealer does not have enough money to cover a player's bet, the player is given a "Free Play" button or other token by the House Dealer, which is good for his/her collection on another hand.

Some gaming establishments may choose to limit the players' and the Dealer's options. They may allow hitting or standing only on hands of certain value or hands of a certain value with a specified number of cards. Other gaming establishments may allow the player to make decisions freely. All of these options are part of the game Pan 9 Gold.

Figure 2:
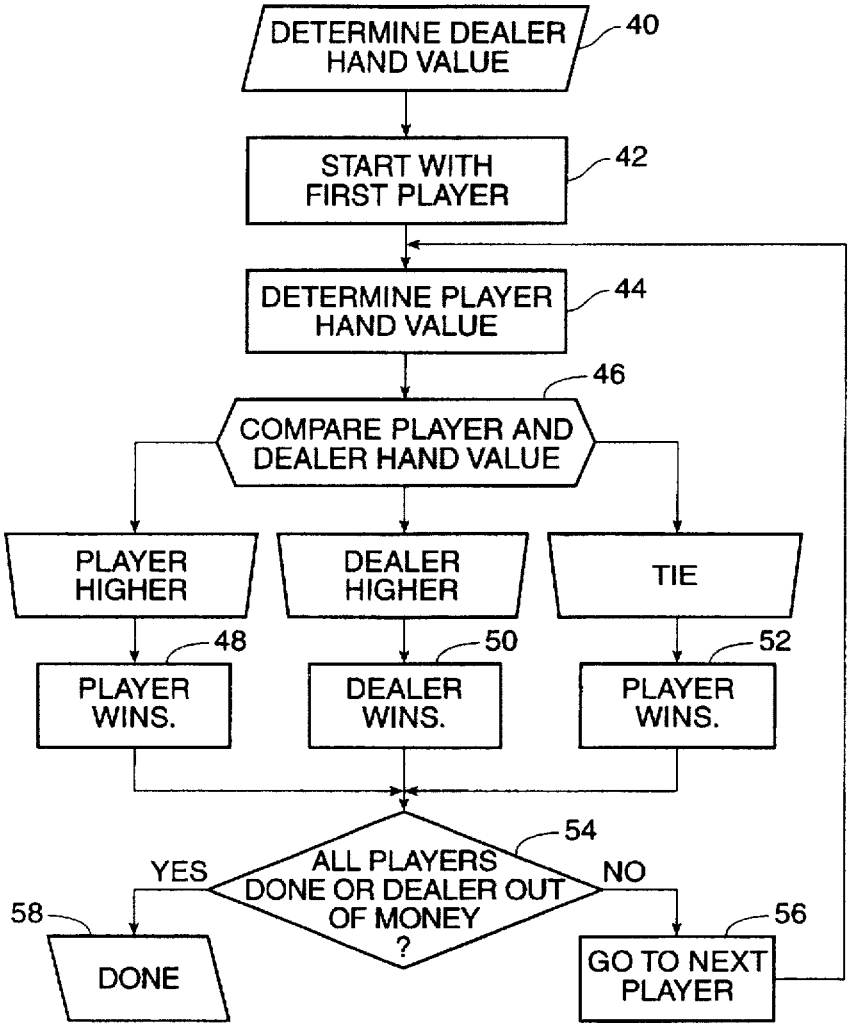
FIG. 2 is a flow chart illustrating the process of deciding winners according to the preferred embodiment of Pan 9 Gold.
Figure 3:
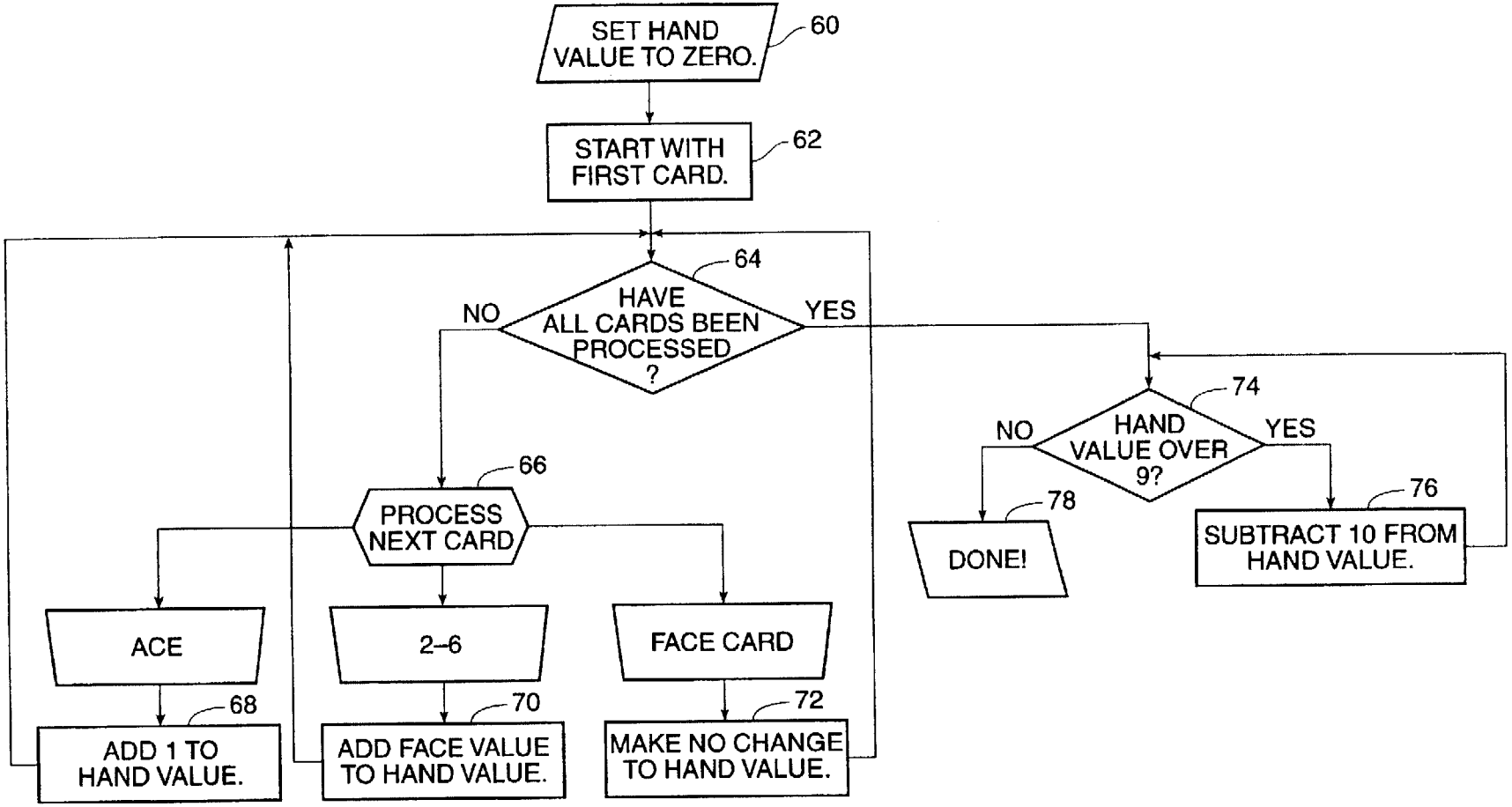
FIG. 3 is a flow chart illustrating how to evaluate a Pan 9 Gold hand.

The play of Pan 9 Gold, where a player is designated as the Dealer, according to the present invention may be easily understood with reference to FIGS. 1 through 3, which comprise flow charts illustrating the progress of the game.

Referring to FIG. 1, a flow chart of play of the game Pan 9 Gold according to the present invention is presented. First the Dealer is chosen. At step 10, it is determined whether the current Dealer has been Dealer for more than a predetermined number of hands. As presently preferred, two hands is the predetermined number. If the present Dealer has been Dealer for the predetermined number of hands, a new Dealer is selected by a predetermined protocol. As shown in steps 12 and 14, the predetermined protocol is to offer Dealer status to the next player to the Dealer's left until a player accepts the option to be Dealer. Those of ordinary skill in the art will recognize that other protocols could be used as well.

Once a new Dealer is chosen as a result of steps 12 and 14, or it has been determined at step 10 that the present Dealer has not been Dealer for the predetermined number of hands, play proceeds to step 16, where bets are placed by the Dealer and the players. Next, at step 18, hands are dealt to the players and the Dealer by the House Dealer.

At step 20, the current player decides whether to take a card. If the player chooses to do so, at step 22 the player is given a fourth card by the House Dealer. As shown in step 24, step 20 and step 22 (when required) are repeated for all players.

Next, at step 26, the Dealer's cards are turned up. The play of the Dealer's hand is shown in steps 28 through 34. In step 28, the Dealer decides whether to take a fourth card. If so, the card is dealt at step 30 and at step 32 the Dealer may decide whether to take a fifth card. If so, at step 34 the fifth card is dealt.

Then at step 36, the winners are determined and at step 38, the bets are settled, the play of the hand is over, and play of the next hand begins after a return to step 10.

Referring now to FIG. 2., a flow chart illustrates the process of deciding winners from step 36 of FIG. 1. First, at step 40, the Dealer's hand value is determined. Next at step 42, the first player is determined and at step 44 the player's hand value is determined. At step 46 the player's hand value is compared to the Dealer's hand value.

Based on this comparison, step 48, 50, or 52 follows. If the player's hand value is higher than the Dealer's hand value, at step 48, the player wins. If the Dealer's hand value is higher than the player's hand value, at step 50, the Dealer wins. If the player's hand value equals the Dealer's hand value, at step 52, the player wins.

After step 48, 50, or 52, at step 54, it is determined if there are more players left and the Dealer has money to cover more bets. If both conditions hold, at step 56, the process goes to the next player, and the procedure starting at step 44 begins for this player. If either of these two conditions does not hold, at step 58, the hand is complete.

Referring now to FIG. 3., a flow chart illustrates the process of determining the value of hand from steps 40 and 44 of FIG. 2. First, at step 60, the hand value starts at zero. At step 62, processing starts with the first card in the hand. At step 64, it is determined if all the cards in the hand have been processed. If there are cards remaining to be processed, the next card is processed at Step 66. If the card is an ace, at step 68, one is added to the value of the card. If the card is a two, three four, five or six, at step 70 the face value of the card is added to the hand value. If the card is a picture card (King, Queen, or Jack), at step 72 the hand value remains the same. After step 68, 70 or 72, step 64 is repeated.

Once all the cards have been processed, at step 74 it is determined whether the hand value is over 9. If it is, at step 76, ten is subtracted from the hand value and step 74 is repeated. When the hand value is nine or less, at step 78, evaluating the hand is finished and the correct hand value has been determined.

The Pan 9 Gold card game of the present invention may be played on any card table. However, it is contemplated that a table layout such as that depicted in FIG. 4 may be used. As may be seen from an examination of FIG. 4, the table 140 is preferably (but not necessarily) one half of an oval (or a flattened semicircle). The House Dealer stands along the straight side 142 of the table 140. The table 140 may be fitted with a rectangular hole (not shown) into which the House Dealer may place a tray to hold chips.

There are a plurality of numbered Player Areas spaced around the curved side of the table 140. Eight Player Areas 144, 146, 148, 150, 152, 154, 156, and 158 are shown on the table 140. Up to eight hands may be dealt on the table 140, one to each Player Area 144, 146, 148, 150, 152, 154, 156, and 158. A hand is dealt to any Player Area 144, 146, 148, 150, 152, 154, 156, and 158 where there is a bet. The player who is acting as Dealer occupies one of the eight Player Areas 144, 146, 148, 150, 152, 154, 156, and 158.

In front of each Player Area 144, 146, 148, 150, 152, 154, 156, and 158 are a group of three circular Betting Spots 160, 162, 164, 166, 168, 170, 172, and 174 with the number 1, 2 or 3 in it. A player who wishes to bet more than the table limit may place a bet of the table limit on the spot with the number "1" in it and then additional bets in the spot with the number "2" in it or in the spots with both "2" and "3" in them.

In front of each group of Betting Spots 160, 162, 164, 166, 168, 170, 172, and 174 is a corresponding group of circular Collection Spots 180, 182, 184, 186, 188, 190, 192, and 194 with the letter "C" inside. These spots are used to pay the house collection on each hand. For each Betting Spot 160, 162, 164, 166, 168, 170, 172, and 174 where there is a wager, there must be a house collection on the corresponding Collection Spot 180, 182, 184, 186, 188, 190, 192, and 194.

In front of the Collection Spots 180, 182, 184, 186, 188, 190, 192, and 194 there is a rectangular Hit Box 200, 202, 204, 206, 208, 210, 212, and 214 for each Player Area 144, 146, 148, 150, 152, 154, 156, and 158, slightly larger than a playing card. The Hit Box 200, 202, 204, 206, 208, 210, 212, and 214 has the word "Hit" written inside and has the longer edge of the rectangle facing the player. If a Player wishes to have a card added to his/her hand, (s)he places the hand in the Hit Box 200, 202, 204, 206, 208, 210, 212, and 214 to indicate this to the House Dealer.

In front of the Hit Box 200, 202, 204, 206, 208, 210, 212, and 214 is a Stand Box 220, 222, 224, 226, 228, 230, 232, and 234 for each Player Area 144, 146, 148, 150, 152, 154, 156, and 158, also slightly larger than a playing card. The Stand Box 220, 222, 224, 226, 228, 230, 232, and 234 has the word "Stand" written inside and has the shorter edge of the rectangle facing the player. If a player does not wish to have a card added to his/her hand, (s)he places the hand in the Stand Box 220, 222, 224, 226, 228, 230, 232, and 234 to indicate this to the House Dealer.

Figure 4:
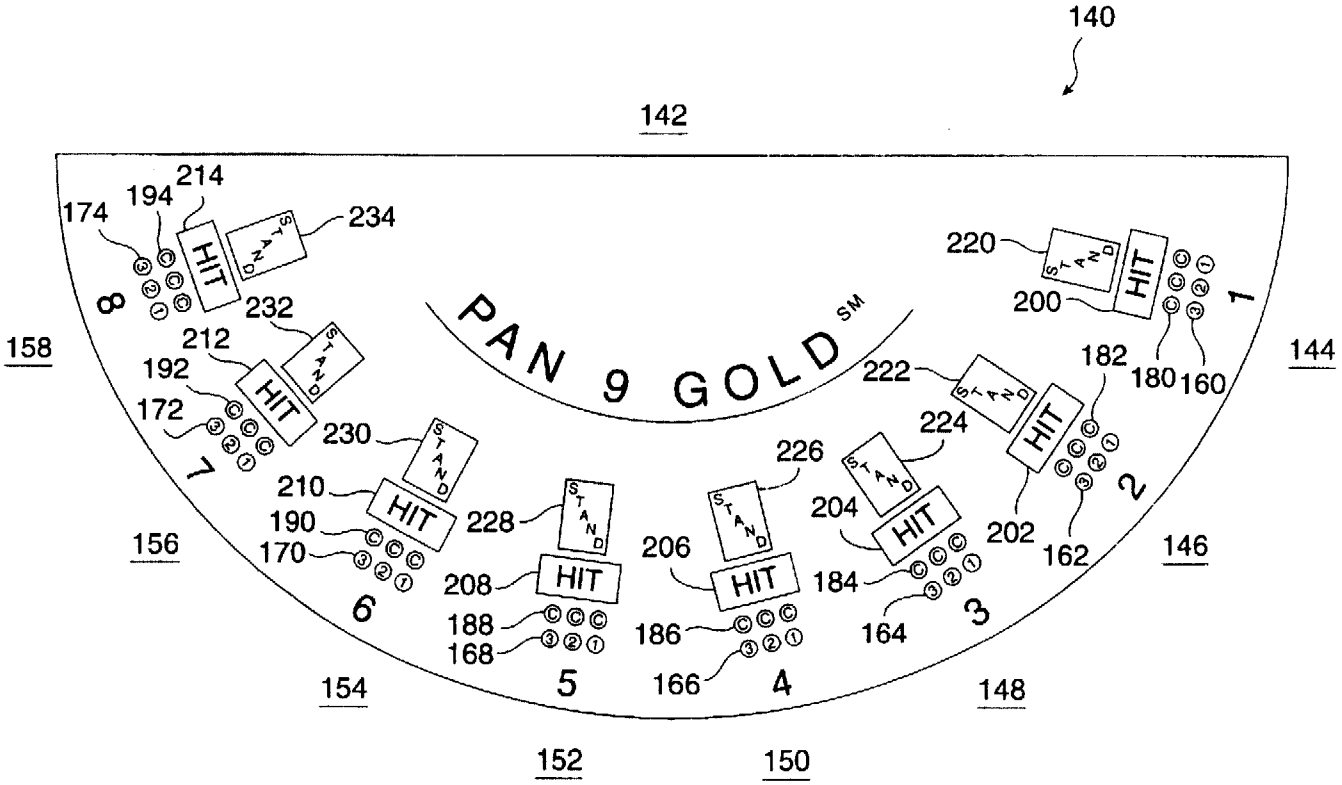
FIG. 4 is a diagram of a typical table layout for playing Pan 9 Gold.

Those of ordinary skill in the art will recognize that the table layout shown in FIG. 4 is merely illustrative and the particular configuration shown herein is not necessary to play the game.

While embodiments and applications of this invention have been shown and described, it would be apparent to those skilled in the art that many more modifications than mentioned above are possible without departing from the inventive concepts herein. The invention, therefore, in not to be restricted except in the spirit of the appended claims.

What is claimed is:

1. A method of playing a card game comprising:

providing at least one deck of standard playing cards with the sevens through tens removed;

establishing numerical values for each card in the deck by assigning numerical cards their face value and Aces=1, Jacks=0, Queens=0, and Kings=0 with no suit designation;

identifying one player as a "Dealer";

requiring each player and the Dealer to wager a sum of money before the play;

dealing each player and the Dealer a hand of three cards face down;

optionally adding only one card face down to each player's hand at the player's request so that each player has a maximum of four cards in his/her hand;

turning over the Dealer's hand;

optionally adding one card face up to the Dealer's hand at the Dealer's request and if a first additional card is added to the Dealer's hand then optionally adding a second additional card face up to the Dealer's hand at the Dealer's request;

separately establishing a value for each player's hand and the Dealer's hand by totalling up the numerical value of the cards and successively reducing the total by ten until the total is between zero and nine; and separately comparing the value of each player's hand with the value of the Dealer's hand and awarding the money to a winner between that player and the Dealer wherein the player is the winner if the value of the player's hand is greater than or equal to the value of the Dealer's hand and wherein the Dealer is the winner if the value of the Dealer's hand is greater than the value of the player's hand.

2. The method of claim 1 wherein the Dealer may not be dealt an additional card if the Dealers's hand has a value of six.

3. The method of claim 1 wherein the Dealer may not be dealt any additional cards if the Dealer's hand is made up of three cards and has a value of six.

4. The method of claim 1 wherein the Dealer may not be dealt an additional card if the Dealer's hand is made up of four cards and has a value of six.

* * * * *